United States Patent [19]

Theurer et al.

[11] 4,430,946

[45] Feb. 14, 1984

[54] MOBILE MACHINE AND METHOD FOR COMPACTING BALLAST

[75] Inventors: Josef Theurer, Vienna; Johann Hansmann, Klosterneuburg, both of Austria

[73] Assignee: Franz Plasser Bahmbaumaschinen-Industrie-Gesellschaft m.b.H., Vienna, Austria

[21] Appl. No.: 313,606

[22] Filed: Oct. 21, 1981

[30] Foreign Application Priority Data

Jan. 16, 1981 [AT] Austria ..... 172/81

[51] Int. Cl.[3] ..... E01B 27/17

[52] U.S. Cl. ..... 104/7 B; 104/12

[58] Field of Search ..... 104/7 R, 7 B, 8, 12

[56] References Cited

U.S. PATENT DOCUMENTS

| | | | |
|---|---|---|---|
| 3,919,943 | 11/1975 | Plasser et al. | 104/7 R |
| 3,926,123 | 12/1975 | Plasser et al. | 104/7 R |
| 3,965,822 | 6/1976 | Stewart | 104/7 B |
| 4,046,078 | 9/1977 | Theurer | 104/7 R |
| 4,046,079 | 9/1977 | Theurer | 104/8 X |
| 4,066,020 | 1/1978 | Theurer | 104/12 X |
| 4,068,596 | 1/1978 | Theurer | 104/12 |
| 4,125,075 | 11/1978 | Stewart | 104/7 B |

*Primary Examiner*—Randolph Reese

*Attorney, Agent, or Firm*—Kurt Kelman

[57] ABSTRACT

In a mobile machine for compacting ballast supporting a track, a machine frame carries a tie tamping unit and a track stabilization unit mounted rearwardly of the tamping unit in the operating direction of the machine. The track stabilization unit is mounted on the machine frame between the tamping unit and one of the undercarriages immediately following the tamping unit. No undercarriage supports the machine frame on the track between the tamping unit and the one undercarriage.

21 Claims, 11 Drawing Figures

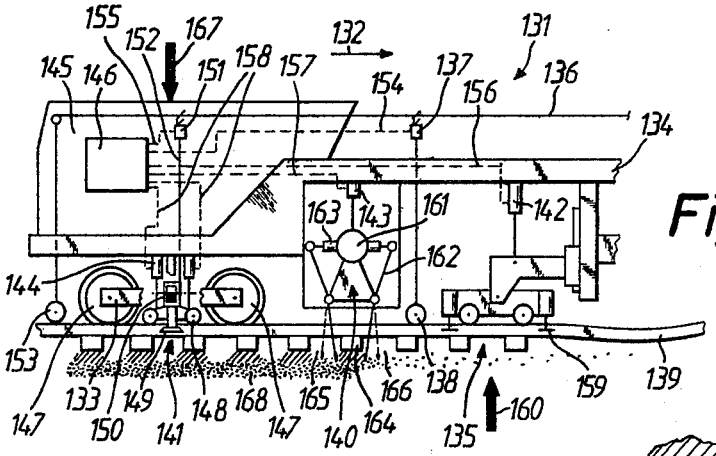
Fig.8
Fig.9
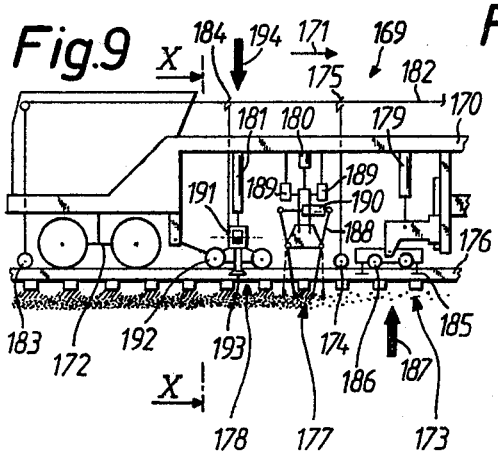
Fig.10
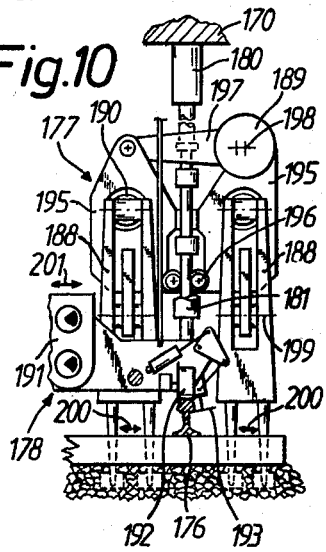
Fig.11
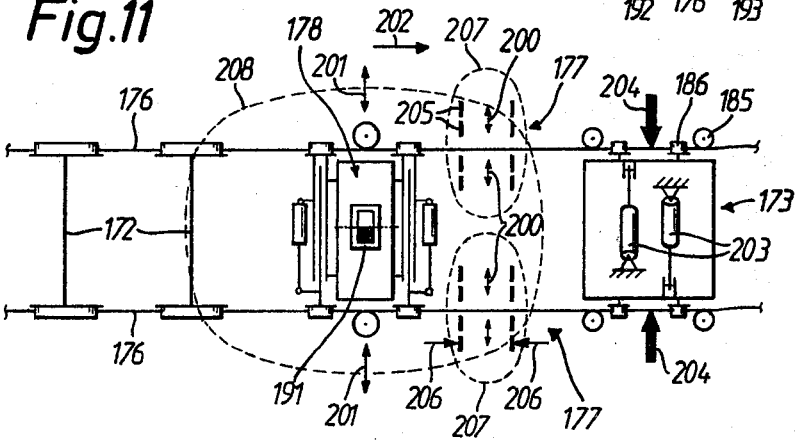

MOBILE MACHINE AND METHOD FOR COMPACTING BALLAST

The present invention relates to improvements in a mobile machine and method for compacting ballast of a ballast bed supporting a track consisting of two rails fastened to ties resting on the ballast, and more particularly to a track tamping, leveling and lining machine used for this purpose.

A known machine of this type comprises a machine frame, undercarriages supporting the machine frame on the track rails for movement in an operating direction, a ballast tamping unit vertically movably mounted on the machine frame and including pairs of reciprocable and vibratory tamping tools arranged to tamp ballast under respective ones of the ties upon immersion of the tamping tools in the ballast when the tamping unit is vertically moved, a track correction unit mounted on the machine frame forwardly of the tamping unit in the operating direction and a track correction reference system for controlling the track correction unit. A track stabilization unit may be mounted on the machine frame rearwardly of the tamping unit in the operating direction and this unit includes a chassis, guide roller means firmly holding the chassis in engagement with the track rails and guiding the chassis along the track upon movement of the machine frame in the operating direction, vibrator means for imparting essentially horizontal vibrations to the track, and power drive means connecting the chassis to the machine frame and arranged to impart essentially vertical load forces to the chassis. The machine may have control means for operating the ballast tamping, track correction and track stabilization units.

A track tamping and leveling machine of this general type has been disclosed, for example, in U.S. Pat. No. 3,926,123, dated Dec. 16, 1975. This machine has a frame supported on two undercarriages and having a frame portion overhanging the front undercarriage. The tamping unit is mounted on the overhanging frame portion and the track stabilization unit is mounted on the machine frame between the two undercarriages. With this machine, the track is brought to the desired level, is fixed at this level by tamping the ballast under the track supporting ties and the position of the leveled track is then stabilized.

According to U.S. Pat. No. 4,046,078, dated Sept. 6, 1977, a mobile machine frame supporting a track stabilization unit between two undercarriages is coupled to a mobile track tamping, leveling and lining machine for stabilizing the track after the track has been leveled, lined and tamped. During the dynamic track stabilization effected with these prior art machines, the previously tamped ballast is so fluidized as to become denser, thus reducing the volume of the ballast bed and causing the track to sink to a lower level. This anticipates the kind of ballast settling occurring normally under train traffic subsequent to track tamping operations and enhances the resistance of the tamped ties to transverse movement relative to the ballast bed. Since the track stabilization unit chassis is downwardly pressed while being vibrated horizontally in a direction transverse to the track, it causes the firmly gripped track to be embedded in the fluidized ballast against lateral movement of the ties while the ballast is further densified. In this manner, the tamped ballast is further compacted under the ties and at their ends, which reduces the ballast volume and lowers the level of the track supported thereon. This type of track stabilization has been very successful in practice and has greatly increased the durability of a corrected track position.

It is the primary object of this invention further to improve such track stabilization apparatus and methods by simplifying their structure and enhancing their effectiveness.

The above and other objects are accomplished according to one aspect of the invention in a mobile machine of the first described type by mounting the track stabilization unit in a range of the machine frame extending from the tamping unit to one of the undercarriages immediately following the tamping unit, no undercarriage supporting the machine frame on the track between the tamping unit and the one undercarriage.

According to another aspect of the present invention, the ballast is compacted by tamping the ballast under respective ones of the ties in a tamping zone, simultaneously imparting to the track essentially horizontal vibrations extending transversely to the track and subjecting the track to essentially vertical load forces in a zone immediately adjacent to the tamping zone whereby the ballast in the adjacent zone is so fluidized that the ballast attains a maximum density and a correspondingly reduced volume, causing the track supported thereon to sink to a desired level, and holding the track at the desired level under the load of one of the undercarriages rearwardly of the adjacent zone in the operating direction.

This very simple as well as unexpectedly effective machine and method is based on the insight that tamping the ties and immediately subsequent thereto dynamically stabilizing the track without subjecting the track to the load of an undercarriage running over the corrected track before it has been stabilized enhances the effectiveness of both operations by superimposing the two operating zones on eath other. In the prior art described hereinabove, an undercarriage between the ballast tamping unit and the track stabilization unit transmits the load of the heavy track correction machine to the track and the ballast, and the subsequent fluidization of the ballast bed during the dynamic stabilization may disturb the corrected track position. This cannot occur in the machine and method of this invention, and the effect of the stabilization extends directly into the tamping zone, thus superimposing the ballast compaction obtained by the track stabilization on that obtained by the ballast tamping. This ballast compacting effect enhances the ballast compaction obtained by the reciprocating and vibrating tamping tools so that the ballast support under the ties is greatly improved, the ballast under the ties being unusually dense and imparting to it a high carrying capacity. The track stabilization causes the ties to be strongly anchored in the highly compacted ballast and thus produces a very durable track positioning which is particularly resistant to lateral displacement and is well settled against downward movement under the pressure of trains passing over the track.

In addition, the machine and method of the invention greatly reduces manufacturing and operating personnel costs. The entire operation is within ready range of vision of a single operator so that he can readily make any required tool adjustments on the basis of observation, thus saving later corrections. Existing track surfacing machines may be readily equipped with existing track stabilization units without essential changes in either structure.

More particularly, a very effective and compact mobile track surfacing machine with a wide range of operating possibilities may be produced in accordance with the present invention by mounting a track stabilization unit on a track tamping, leveling and lining machine in the indicated manner. But this invention also offers selective possibilities with respect to the use of the various units. More particularly, it is possible to operate the power drive and/or vibrator means of the track stabilization unit selectively in such a manner as to adapt the vertical load on the track and its horizontal vibration to specific ballast conditions so as to obtain a desired track position or a maximum density of the ballast. With the track stabilization unit and the ballast tamping unit combined in the manner of this invention, the effectiveness of the track stabilization is not reduced during the other surfacing operations. For the first time, a uniformly compact and continuous ballast bed is produced by the more or less simultaneous tamping of the ballast and dynamic stabilization of the track.

The method of the present invention provides an entirely new track surfacing technology in accordance with which the tamped ballast is again compacted in a zone immediately adjacent the tamping zone, the two zones flowing into each other. Thus, an extended track section having a continuous compacted ballast bed is produced, which considerably increases the durability of the track position because the track section remains under constant load during the surfacing operation not only in the range of the track stabilization unit but also in the range of the subsequent undercarriage which is combined with, or follows, the stabilization unit. The operating steps may be so synchronized with each other that a single pass of the machine may produce a substantially ideal ballast and track condition over an extended track section and for a long time, which is not only immediately ready for high-speed train traffic but also assures long duration to the corrected track because the dynamic stabilization has anticipated the initial settling of the track in traffic. Such methods are, therefore, especially useful for surfacing high-speed tracks. The automatic method of this invention produces for the first time a compact and continuous ballast compacting zone obtained by the simultaneous tamping of ballast under the ties and the dynamic stabilization of the track. In this method, the track stabilization proceeds independently of the ballast tamping but is closely coordinated therewith.

The above objects, advantages and features of the present invention will become more apparent from the following detailed description of certain now preferred embodiments thereof, taken in conjunction with the generally schematic drawing wherein FIG. 1 is a side elevational view of a mobile machine according to one embodiment of this invention;

FIG. 8 is a partial side elevational view of still another embodiment constituting a track tamping, leveling and lining machine wherein the track stabilization unit is arranged in the range of the rear undercarriage of the machine;

FIG. 9 is another partial side elevational view of yet another embodiment wherein the tamping tools are arranged for transverse vibration;

FIG. 10 is a section along line X—X of FIG. 9; and

FIG. 11 is a top view similar to that of FIG. 2, diagrammatically showing the vibration zones of the track stabilization and ballast tamping units of the machine of FIG. 9.

Figure 1:
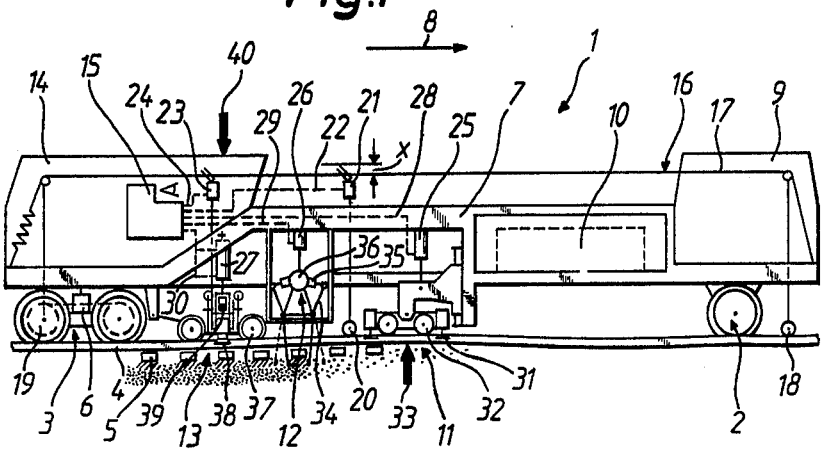
Figure 2:
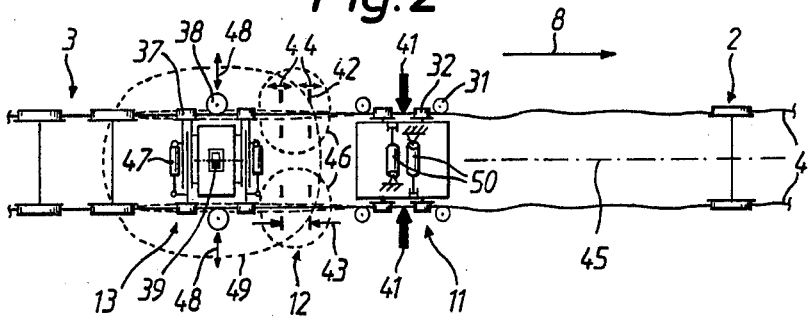
FIG. 2 is a diagrammatic top view of the working tool units of the machine of FIG. 1.

Referring now to the drawing and first to FIGS. 1 and 2, there is shown mobile machine 1 for compacting ballast of a ballast bed supporting a track consisting of two rails 4 fastened to ties 5 resting on the ballast. The machine comprises machine frame 7 and undercarriages 2, 3, supporting the machine frame on the track rails for movement in an operating direction indicated by arrow 8. Drive 6 powers rear undercarriage 3 to move the machine in the operating direction. Operator's cab 9 is mounted on the front end of machine frame 7 which also carries power plant 10 for the machine. Between the power plant and the rear undercarriage, which is shown as a double-axle swivel truck, machine frame 7 carries ballast tamping unit 12, track correction unit 11 forwardly of the tamping unit in the operating direction and track stabilization unit 13 rearwardly of the tamping unit in the operating direction. Preferably, a respective ballast tamping unit is associated with each rail 4 and each tamping unit includes pairs of reciprocable and vibratory tamping tools 34 arranged to tamp ballast under respective ties 5 upon immersion of the tamping tools when vertically movably mounted tamping unit 12 is vertically moved. Another operator's cab 14 is mounted on the rear end of machine frame 7 for operating and monitoring the work of units 11, 12 and 13, cab 14 housing control means 15 for operating the units. Machine 1 is also equipped with track correction reference system 16 for controlling track correction unit 11.

In the illustrated embodiment, track correction unit 11 includes means for lifting and transversely moving the track and the reference system includes the illustrated system for leveling the track and a system for lining the track, machine 1 being a track tamping, leveling and lining machine. In the illustrated machine, machine frame 7 is an elongated frame supporting track correction, ballast tamping and track stabilization units 11, 12 and 13 between the two undercarriages 2 and 3. The means for lifting and transversely moving the track is comprised of lifting rollers 31 and lining rollers 32 gripping track rails 4, lifting jack 25 for raising the track in the direction indicated by arrow 33 and lining jacks 50 for transversely moving the track in a selected direction indicated by arrow 41. The illustrated reference system for leveling the track is comprised of two reference wires 17 respectively associated with rails 4. The front ends of the reference wires are supported at the front end of machine frame 7 by a sensing element 18 which runs on the rails in a range of the track which has not yet been leveled and thus indicates the uncorrected level of the track while the rear ends of the reference wires are supported on rear axle 19 of undercarriage 3 to indicate the corrected track level. If desired, a separate sensing element like element 18 could support the rear end of each reference wire in the leveled track range. A further track level sensing element 20 is arranged between track correction unit 11 and ballast tamping unit 12 and the upper end of sensing element 20 carries track level measuring sensor 21 which, when contacting reference wire 17, emits a leveling control signal transmitted by line 22 to control means 15 connected to lifting jack 25 by line 28.

Just as the above-described track correction unit and the reference system associated therewith, the ballast tamping unit illustrated herein is conventional and comprises pairs of reciprocable tamping tools 34 whose centrally arranged hydraulic reciprocating drive 35 is connected to common vibrating drive 36 mounted between the pairs of tamping tools. Hydraulic jack 26 links tamping unit 12 to machine frame 7 for vertical movement of the unit on command from control means 15 connected to jack 26 by line 29.

According to the present invention, track stabilization unit 13 is mounted on machine frame 7 rearwardly of tamping unit 12 in the operating direction indicated by arrow 8 and in the range of the machine frame extending from the tamping unit to rear undercarriage 3 immediately following the tamping unit, no undercarriage supporting machine frame 7 on the track between tamping unit 12 and undercarriage 3. The track stabilization unit includes a chassis and guide roller means 37, 38 firmly holding the chassis in engagement with track rails 4 and guiding the chassis along the track upon movement of machine frame 7 in the operating direction. Vibrator means 39 are arranged to impart essentially horizontal vibrations to the track and a power drive means illustrated as hydraulic jack 27 connects the chassis to machine frame 7 and is arranged to impart essentially vertical load forces to the chassis. In the illustrated embodiment, track stabilization unit 13 is equipped with track level measuring sensor 23 which, like sensor 21, emits a control signal upon contact with reference wire 17. This control signal is transmitted by line 24 to control means 15 and the latter is connected by line 30 to power drive means 27 for controlling the operation of this power drive means of track stabilization unit 13. In this manner, control means 15 controls the vertical movements of units 11, 12 and 13 by jacks 25, 26 and 27.

The illustrated guide roller means of the track stabilization unit comprises two sets of flanged guide rollers 37 supporting the chassis of the unit for movement on the track rails and two gripping rollers 38 mounted between the two sets of flanged guide rollers and capable of being pivoted in a transversely extending vertical plane into and out of gripping engagement with the outside of the head of each rail, each gripping roller snugly subtending the underside of each rail head when it is pivoted into engagement with the respective rail. The flanged guide rollers of each set are firmly pressed against the insides of the heads of both rails 4 by spreading drives 47 which hold the flanged guide rollers in this engaging position during track stabilization. In this manner, unit 13 is firmly held in tight engagement with the track rails so that the track will move substantially integrally with the unit. Vibrator means 39 is arranged on the chassis of the track stabilization unit for imparting essentially horizontal vibrations to the track in a direction extending transversely to the track, as taught in the above-mentioned U.S. patents. These vibrations as well as the vertical load forces imparted by jack 27, indicated by arrow 40, are transmitted to the track by guide roller means 37.

The respective ballast tamping zones and dynamic track stabilization zone are indicated diagrammatically in FIG. 2 by circles shown in broken lines. When tamping jaws 42 of tamping tools 34 are immersed in the ballast, with the pairs of tools straddling a respective tie 5, and the tamping tools are reciprocated in the direction of arrows 43 while being vibrated in the direction of double-headed arrows 44 in a direction parallel to track axis 45, in the illustrated embodiment, ballast is tamped under the tie in tamping zone 46.

The vibratory motions of the track stabilization unit during dynamic track stabilization are indicated by double-headed arrows 48 and cause rails 4 in the range between track correction unit 11 and rear swivel truck 3 to be alternately elastically deformed to the left and to the right, as shown in highly exaggerated form in broken lines, and these vibrations are transmitted by ties 5 to the ballast, causing the same to be fluidized while the downward pressure of hydraulic jack 27 causes the fluidized ballast to move closely together to reach a very high density. The dynamic stabilization zone thus created is indicated by circle 49. As shown in FIG. 2, the tamping and dynamic stabilization zones overlap so that the compaction of the ballast by tamping tools 34 and by vibrating stabilization unit 13 flows together into zones of increasing ballast density which reaches its maximum under the load of undercarriage 3 which is immediately adjacent stabilization zone 49.

The operation of the above-described machine will partly be obvious from the description of its structure and will now be set forth in further detail:

The machine is advanced along the track in the operating direction indicated by arrow 8 intermittently from tamping zone to tamping zone. At each tamping zone, machine 1 is stopped, ballast tamping unit 12 is lowered for immersion of the tamping jaws in the ballast and the track is leveled and lined by actuating lifting drive 25 and a respective lining drive 50 in the direction of arrows 33 and 41. When the track has reached the desired level between track correction unit 11 and tamping unit 12, track level measuring sensor 21 will make contact with level reference system 16 and emit a control signal transmitted to control means 15. Line 28 connects the control means to jack 25 to stop operation of the lifting jack in response to the control signal. However, since the subsequent dynamic stabilization by unit 13 will condense the ballast further, and therefore, lower the level of the track resting on the ballast, an empirically determined value x is incorporated into the control means to delay the stopping of the lifting jack sufficiently to raise the track above the desired level by value x. Tamping unit 12 is now operated to tamp ballast under tie 5 and either simultaneously with the tamping of the tie in the tamping zone, or subsequently thereto, track stabilization unit 13 is vibrated and the track level is determined thereat by track level measuring sensor 23 in the same manner as with sensor 21. The emitted control signal is transmitted by line 24 to control means 15. If the measured track level corresponds to the desired track level, the operation of the track stabilization unit is continued without change. Control means 15 is so programmed that, if there is a difference between the measured and the desired track levels, the control means will change the operation of the track stabilization unit, i.e. the head of the hydraulic medium in jack 27 and/or the frequency of vibration imparted to the chassis of the unit by vibrator means 39, so that the degree of ballast compaction attained by the dynamic stabilization is commensurate with the desired track level, this level being a function of the ballast bed level which, in turn, is determined by the density of the ballast in the bed. Such programming is well within the capability of commercially available electronic controls operating control elements for the operation of hydraulic jack 27 and vibrator means 39 of track stabilization unit 13.

Preferably, track stabilization unit 13 is arranged immediately rearwardly of ballast tamping unit 12 and as close thereto as possible. This arrangement best meets the basic structural concept of providing a mobile track tamper of medium to highest efficiency in which the two ballast compaction units are mounted on the machine frame without waste of space just ahead of the nearest machine frame supporting undercarriage and may be operated and monitored from a single cab. In addition, this arrangement will assure that a relatively large portion of the weight of the entire machine will be transmitted to the chassis of the track stabilization unit so as to increase the vertical load forces imparted thereto as one component of the dynamic track stabilization. Most particularly, the vibrations of the track stabilization unit will be advantageously transmitted into the tamping zone, thus enhancing the quality of the tie tamping.

Where control means 15 comprises a control for operating power drive means 27 and vibrator means 39 of track stabilization unit 13 and the control is responsive to system 16 for leveling the track, the final track level obtained by the track stabilization may be so controlled that it conforms accurately to the desired track level, the differential between the track levels measured at the ballast tamping unit and the track stabilization units, respectively, controlling the dynamic track stabilization. This fine control is particularly simple when the same track level reference system is used for the track correction unit and the track stabilization unit, both units being under the control of a control means responsive to this system. This fine control preferably comprises means for selectively imparting to the power drive and vibrator means 27 and 39 of the track stabilization unit a predetermined vibrating frequency and/or force, and control means 15 is arranged to operate this selective operating means. In this manner, the operation may be fine-tuned to particular track conditions, a similar result being obtainable if vibratory means 36 is arranged for selectively vibrating tamping tools 34 outside their tamping cycle for tamping ballast under respective ties 5. Thus, if the ballast is heavily encrusted, it may be advantageous to operate the track stabilization unit at higher frequency and under a smaller vertical load to facilitate the penetration of the tamping tool jaws into the ballast during the immersion of the tools. Contrariwise, if the ballast bed is relatively loose and if a particular track section is to be brought to a considerably lower level, it will be useful to operate the track stabilization unit at a low vibratory frequency but under a higher vertical load.

In the ballast compacting method described hereinabove, the ballast is tamped under respective ties in a tamping zone. Essentially horizontal vibrations extending transversely to the track are imparted thereto and the track is simultaneously subjected to essentially vertical load forces in a zone immediately adjacent to the tamping zone whereby the ballast in the adjacent zone is so fluidized that the ballast attains a maximum density and a correspondingly reduced volume, causing the track supported thereon to sink to a desired level. The track is held at the desired level under the load of one of the undercarriages of the mobile machine rearwardly of the adjacent zone in the operating direction. The adjacent zone is preferably so close to the tamping zone that the ballast is fluidized into the tamping zone.

As described in connection with a preferred embodiment, the track may be first raised slightly above a desired level, the ballast is tamped at this level, and the track is then lowered to the desired level by fluidizing the ballast and holding the track at the desired level under the load of the one undercarriage. The level of the track is measured before and after tamping to obtain actual level measuring values, the values are compared with a value of the desired track level and any required raising and subsequent lowering of the track level is determined on the basis of the comparison values. The vertical movement of the track is automatically controlled in response to the comparison values in relation to a reference system.

This preferred method rationally coordinates the tamping and track stabilization cycles. It is very advantageous not only in track sections requiring little lifting but also in track sections subject to relatively extensive initial settling. At such locations, the track may be lifted relatively excessively above the desired level so that the resultant excess ballast volume enables the track to be lowered by a relatively large amount. Such an automatic ballast compacting method will be effective without the provision of limiting devices.

Figure 3:
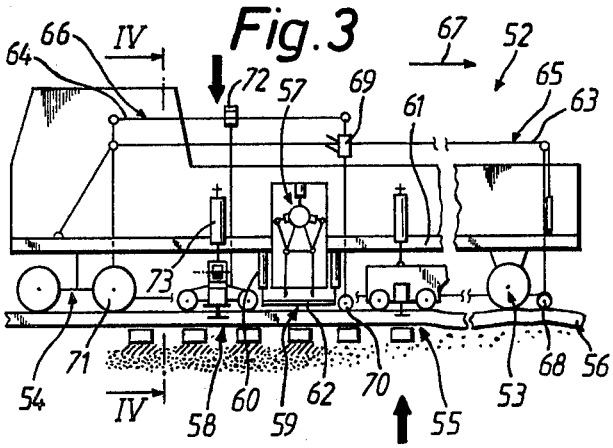
FIG. 3 is another diagrammatic view of another embodiment of the machine, seen in side elevation.

Returning to the drawing, FIG. 3 illustrates track tamping and leveling machine 52 whose machine frame is supported on track rails 56 on undercarriages 53 and 54 for movement in an operating direction indicated by arrow 67. Ballast tamping unit 57, track correction unit 55 and track stabilization unit 58 are vertically movably mounted on the elongated machine frame between the two undercarriages. In this embodiment, the ballast tamping unit comprises vertically adjustable stop 59 cooperating with a respective rail 56 for limiting the vertical movement of the tamping unit. The stop is fixable at an adjusted vertical position. The illustrated stop comprises hydraulic jacks 60 vertically adjustably connected to machine frame 61 for moving elongated beam 62 into engagement with associated rail 56 so that the beam will limit further downward movement of the ballast tamping unit. The jacks may be immobilized to fix the beam in its support position on the rail. Preferably, the adjustment of the stop is responsive to the track correction system. Such an arrangement is of particular advantage when the prevailing track level is to be substantially maintained or only very minor corrections are desired or permissible, as is generally the case with high-speed tracks or track sections whose grade is generally of good quality. In this case, any raising of the track to a desired level is effected largely or solely by upward pressure of the tamped ballast, i.e. by the action of the tamping tools, and the track may be held at the desired level while tamping is continued until a desired ballast density has been attained. The extent of the track lift may then be determined very accurately by the corresponding adjustment of the stop and may be so coordinated with the operation of the track stabilization unit that any lifting of the track by tamping will be compensated by the subsequent lowering of the track level due to the dynamic track stabilization. This method is particularly useful in the surfacing of high-speed track which usually require only minimal track lifts and assures not only highest track level accuracy but also an extending operating life of the leveled track even under heavy traffic conditions.

In contrast to machine 1 of FIGS. 1 and 2, machine 52 has two separate track level reference systems 65 and 66 respectively comprising reference wires 63 and 64. The front end of reference wire 63 is supported on track level sensing element 68 running on the rail in the uncorrected section of the track. The front end of other reference wire 64 is connected to another track level sensing element 70 arranged between track correction unit 55 and ballast tamping unit 57, element 70 carrying track level measuring sensor 69 which emits a control signal on contact with reference wire 63. The rear ends of both reference wires are supported on front axle 71 of rear undercarriage 54 running on the corrected section of the track. Switch sensor 72 is carried by track stabilization unit 58 and forms an electrical contact with reference wire 66.

Figure 4:
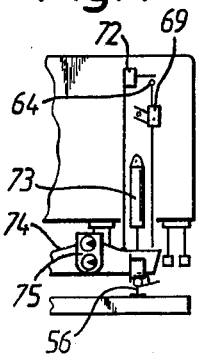
FIG. 4 is a partial sectional view along line IV—IV of FIG. 3.

As shown in FIG. 4, power drive means 73 embodied in a hydraulic jack connects chassis 74 of the track stabilization unit to machine frame 61 to impart essentially vertical load forces to the chassis and vibrator means 75 is arranged to impart essentially horizontal vibrations to the track in a direction transverse to the track. The maximum track lift in the range of ballast tamping unit 57 is accurately controlled and determined by the adjustment of limiting stop 59. With minor lifts, the vertical upward movement against locked stop 59 is accomplished solely by tamping and without the use of track correction unit 55. Track level measuring sensor 69, whose control signal normally would be used to operate the lifting jack of the track correction unit 55, may be used for the continuous control of the adjustment of stop 59 in response to leveling system 65. The control of the subsequent lowering of the track level is effected by second leveling system 66, contact of its reference wire 64 with switch sensor 72 generating a control signal which causes discontinuance of the operation of track stabilization unit 58 as soon as the dynamic stabilization effected by this unit has lowered the track to the desired level determined by reference system 66. The contact of switch sensor 72 with reference wire 64 closes a control circuit switching off operation of jack 73 and vibrator means 75.

Figure 5:
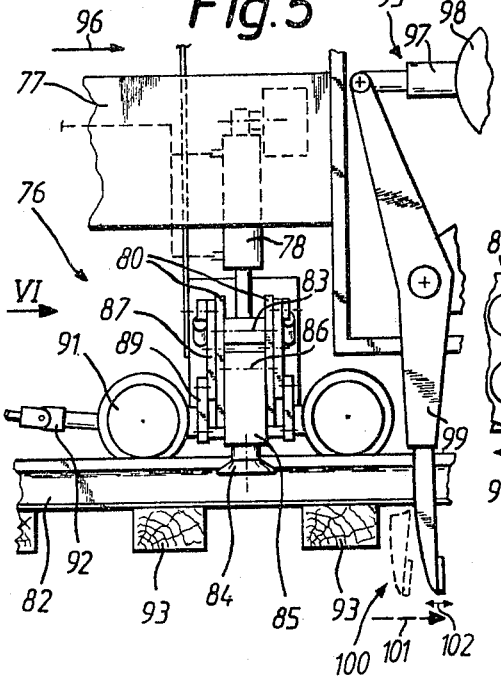
FIG. 5 is an enlarged side elevational view of a track stabilization unit of the type used in the embodiment of FIG. 1.
Figure 6:
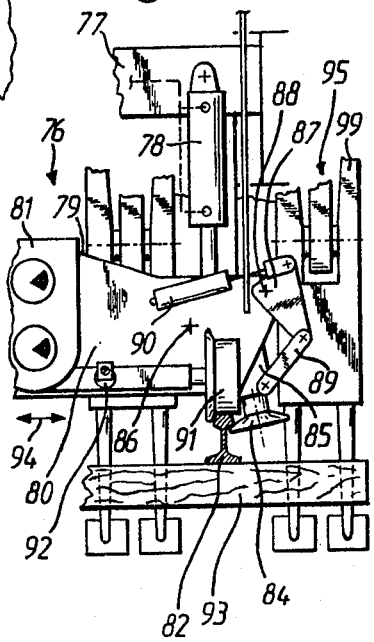
FIG. 6 is a partial front view of the track stabilization unit of FIG. 5, seen in the direction of arrow VI.

FIGS. 5 and 6 show structural details of a slightly modified embodiment of the machine illustrated in FIG. 1. Track stabilization unit 76 of this mobile tamping and leveling machine has its chassis 79 connected to machine frame 77 by two hydraulic jacks 78, respectively extending above, and in substantially vertical alignment with, track rails 82. The chassis is essentially comprised of two plate-shaped carrier plates 80, 80 and vibrator means 81 is rigidly connected to the carrier plates. The jacks link the carrier plates to the machine frame and are pivotally connected thereto for pivoting about axis 83 extending in the operating direction of the machine indicated by arrow 96. Gripping roller 84 of the guide roller means of unit 76 is rotatably journaled in housing 85 which is pivotally supported between carrier plates 80 for pivoting about axis 86 parallel to axis 83. Guide link 87 has one end pivoted to the outer end of each carrier plate 80 for pivoting about axis 88 parallel to axes 83 and 86, the other guide link end being pivoted to link 89 pivotally connected to housing 85 of gripping roller 84. Pivoting jack 90 has one end linked to the carrier plate while its other end is linked to the one guide link end and operation of the pivoting jack will pivot the gripping roller into and out of snug engagement with the outside of the head of rail 82, the flange of the gripping roller subtending the underside of the rail head when it is in snug engagement with the rail head. The gripping roller is centered between flanged guide rollers 91 and cooperates therewith to assure a firm grip on rail 82 when track stabilization unit 76 is subjected to horizontal vibrations and subjected to a vertical load by operation of vibrator means 81 and jack 78. Guide rods 92 link chassis 79 to machine frame 77 in a manner similar to that shown in FIG. 1. Double-headed arrow 94 illustrates the direction of vibration imparted to rails 82 and ties 93, whereto they are fastened, these vibrations being thus transmitted to the ballast on which the track rests for fluidizing the ballast.

As shown in FIG. 5, the track stabilization unit 76 is arranged immediately rearwardly of the ballast tamping unit 95 and as close thereto as possible, the two units actually partially overlapping in the operating direction of the machine. Tamping tools 99 are shown in the drawing in the immersed position and are reciprocable by hydraulic drives 97 and vibrated by vibrating drive 98 for tamping the ballast under a respective tie 93, arrow 101 showing the direction of reciprocation of the tamping tool from a position remote from the tie, indicated in broken lines, to the tamping position shown in full lines. Double-headed arrow 102 indicates the vibratory motion of the tamping tool during tamping.

Figure 7:
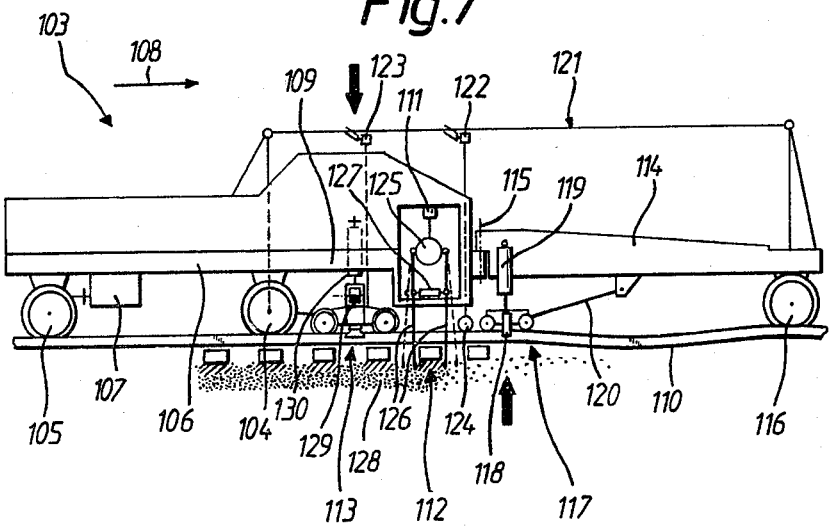
FIG. 7 is a side elevational view of a further embodiment constituting a track tamping, leveling and lining machine with an elongated front beam supported on an additional undercarriage.

FIG. 7 illustrates another embodiment constituted by mobile tamping machine 103 of the so-called overhanging tamper type. This machine has machine frame 106 supported on undercarriages 104 and 105 for movement on track rails 110 in an operating direction indicated by arrow 108, the machine being propelled by drive 107 whose power is transmitted to rear undercarriage 105. The machine frame extends forwardly of front undercarriage 104 and ballast tamping unit 112 as well as track stabilization unit 113 are mounted on forwardly extending machine frame 109. Jack 111 enables the tamping unit to be vertically adjusted and the track stabilization unit is mounted between the tamping unit and front undercarriage 104. The machine frame of this embodiment further comprises elongated carrier 114 connected to the forwardly extending machine frame and another undercarriage 116 supports the elongated carrier on track rails 110. Track correction unit 117 is mounted on the elongated carrier. This type of track tamping, leveling and lining machine wherein a thrust-receiving beam carries the track lifting and lining unit is particularly advantageous for use involving relatively large lifting strokes so that the advantages of this machine type are combined with the dynamic track stabilization obtained by the invention. In this combination, the considerable weight of the forward portion of the machine is available to impart its considerable kinetic energy to the vertical loading of the track stabilization unit. Existing machines of this type may be readily converted for track stabilization by equipping them with unit 113.

As shown in FIG. 7, elongated carrier 114 is linked to machine frame 108 for pivoting about vertical axis 115. The track correction unit of this embodiment uses rail gripping hooks 118 for lifting the track. Leveling is effected by lifting jack 119 and track correction unit 117 is linked to elongated carrier 114 by connecting rods 120.

The leveling reference system illustrated in FIG. 7 is comprised of reference wires whose front end is supported on undercarriage 116 in the uncorrected section of the track while it rear end is supported on front undercarriage 104 of machine 103 in the corrected track section. Two track level measuring sensors 122 and 123 are associated with each reference wire, sensor 122 being mounted on track level sensing element 124 arranged between track correction unit 117 and ballast tamping unit 112 while sensor 123 is carried by track stabilization unit 113. Obviously, in this as well as in the other embodiments, the reference system need not use reference wires but may be incorporated in a system using reference beams of radiated energy, such as infrared or laser beams, and the sensors would then be responsive to such radiation. This type of reference system would in no way alter the operation of the disclosed mobile ballast compacting machine and method.

The ballast tamping unit illustrated in FIG. 7 comprises pairs of tamping tools 126 which are connected intermediate their ends by reciprocating drive 127 and vibrated by a common, centrally arranged vibrating drive 125. Vibrator means 129 impart horizontal vibrations to track stabilization unit 113. The vibrations of the tamping tools substantially in the operating direction of the machine and the vibrations of the track stabilization unit substantially transversely thereto will cooperate to impart such vibrations to the ballast in an extended ballast bed zone 128 that the fluidized ballast will be so repositioned that a very high density will be attained in this continuous zone. This highly compacted ballast will be further solidified and the track level will thus be stabilized for a long period of time by the downward pressure exerted thereon by the subsequent passing of undercarriages 104, 105 of heavy machine 103 over this compacted ballast zone. In the cantilevered construction of this embodiment, the lifting force of jack 119 will serve to reinforce the vertical downward pressure exerted upon track stabilization unit 113 by jack 130, thus further enhancing its effectiveness.

In track tamping, lining and leveling machine 131 shown in FIG. 8, track stabilization unit 141 is arranged on machine frame 134 in the region of the one undercarriage 133 immediately following ballast tamping unit 140. If desired, the track stabilization unit and the one undercarriage may constitute a single mechanical structure. This arrangement is particularly space-saving and thus enables the machine frame to be shortened. In addition, at least a substantial portion of the axle load may be utilized for the vertical loading of the track stabilization unit. Under the rear portion of machine 131 is shown, the machine moving on the track in the operating direction indicated by arrow 132. Track correction unit 135 is vertically movable in relation to machine frame 134 by hydraulic jack 142 for leveling the track in relation to leveling reference system 136 cooperating with track level measuring sensor 137 carried by track level sensing element 138 arranged between unit 135 and ballast tamping unit 140. When sensor 137 contacts the reference system, it emits a control signal which is transmitted by line 154 to control means 146 and line 156 connects the control means to lifting jack 142 of the track correction unit. Hydraulic jack 143 enables the tamping unit to be moved vertically and jacks 144 serve the same purpose for track stabilization unit 141. Control means 146 is arranged on a control panel in operator's cab 145 mounted above rear undercarriage 133 within visible range of the ballast tamping unit. While the stabilization unit and the rear undercarriage form a single mechanical structure, the undercarriage has its own two sets of wheels 147 while guide rollers means 148, 149 firmly hold the chassis of the track stabilization unit in engagement with track rails 139. Vibrator means 150 are mounted on the track stabilization unit chassis which also carries its own track level measuring sensor 151 on rod 152, which cooperates with reference system 136 in the same manner as sensor 137. The rear end of the leveling reference system is supported on track level sensing element 153 running on the corrected track section. Line 155 connects sensor 151 to control means 146 for transmitting the control signals from the sensor to the control means and hydraulic fluid supply lines 156, 157 and 158 connect the control means to jacks 142, 143 and 144. The lifting force is indicated by arrow 160.

In the tamping unit illustrated in FIG. 8, each tamping tool of a pair has its own reciprocating drive 163 and vibrating drive 161 for tamping tools 162 is arranged centrally between the reciprocating drives in substantially vertical alignment with tie 164 being tamped when the tamping tools are immersed in two neighboring cribs 165 and 166 adjacent the tie.

Arrow 167 indicates the direction of the load forces imparted to track stabilization unit 141 by jacks 144 and the weight of the machine on undercarriage 133.

In the operation of machine 131, ballast compacting zone 168 extends from the center of ballast tamping unit 140 to rear undercarriage 133. In this embodiment, the arrangement of jacks 144 will impart considerable vertical load forces to the track stabilization unit without substantially loading wheels 147 of the undercarriage. Therefore, track correction unit 135 will be enabled to execute a considerable track lifting stroke and the ballast level may then be lowered in the range of track stabilization unit 141 to the desired track level under the accurate control of track level measuring sensor 151 which will emit a control signal in response to contact with leveling reference system 136.

FIG. 9 also shows only the rear portion of track tamping, leveling and lining machine 169, machine frame 170 being supported on track rails 176 by rear undercarriage 172 for movement in an operating direction indicated by arrow 171. Similarly to the embodiment of FIG. 8, the machine frame carries track correction unit 173, a respective ballast tamping unit 177 associated with each rail and track stabilization unit 178 between the tamping unit and the rear undercarriage, the three units being closely spaced in the operating direction. Track sensing element 174 between units 173 and 177 carries track level measuring sensor 175 cooperating with travel level reference system 182 and similarly cooperating sensor 184 is mounted on the track stabilization unit. Hydraulic jacks 179, 180 and 181 vertically movably mount the respective units on the machine frame. The rear end of the reference system is supported on track level sensing element 183 running on the corrected track.

The structure of the track correction unit, with its lifting and lining rollers 185, 186 is similar to that of the track correction units hereinabove described and arrow 187 indicates the lifting direction produced by jack 179.

As will be described in more detail hereinafter in connection with FIG. 11, ballast tamping unit 177 comprises—contrary to the tamping units heretofore described—a vibratory drive means 188 for imparting to tamping tools 188 vibrations extending transversely to the operating direction. This vibratory drive means as well as reciprocating drive 190 common to the tamping tools of each pair are illustrated only schematically in FIG. 9.

Track stabilization unit 178 is structurally substantially the same as that shown in FIGS. 5 and 6. Guide roller means 192, 193 firmly hold the chassis of the track stabilization unit in engagement with track rails 176 and vibrator means 191 impart horizontal vibrations thereto, the vertical load imparted thereto by jack 181 being indicated by arrow 194.

As more clearly shown in FIG. 10, all tamping tools 188 at each side of rail 176 are mounted on a common pivotal carrier 195 which is mounted on the tamping tool carrier of unit 177 for pivoting about axis 196 extending in the operating direction of the machine. Common vibrating drive 189 is rigidly connected with the upper end of pivotal tamping tool carrier 195 located at the shoulder side of the rail. The upper end of the gage side carrier 195 for tamping tools 188 is linked to vibrating drive 189 by connecting element 197 extending transversely to the track. Pivotal carriers 195 and tamping tools 188 fixed thereto are mounted for pivoting about axes 199 extending transversely to the track so that the tamping tools are reciprocable in the direction of the track and, as shown by double-headed arrows 200, vibrating drive 189 will impart to the tamping tools vibratory motions in a direction transverse to the operating direction of the machine. Therefore, these vibrations extend substantially in the same direction as the vibrations imparted to track stabilization unit 178 by vibrator means 191, as indicated by double-headed arrow 201, i.e. the vibrations are in phase with each other. For the sake of clarity, power drive means 181 has been shown interrupted in FIG. 10 and this power drive means superimposes a vertical load force indicated by arrow 194 in FIG. 9 on the transverse vibrations imparted to the track stabilization unit.

This arrangement has the advantage that a continuous length of the ballast bed is subjected to vibrations in a more or less continuous ballast fluidizing flow assuring a high compaction of the ballast, which substantially increases the ballast compaction obtainable by separated tie tamping and dynamic stabilization operations used prior to the present invention. Furthermore, the uniform vibration of the ballast in the tamping and stabilization zones, which flow into each other, transversely to the track additionally enhances densification of the ballast. When the vibrations are in phase with each other, the ballast compaction will not only be intensified but also made more uniform throughout the interconnected tamping and stabilization zones.

FIG. 11 illustrates the synergistic operations of ballast tamping unit 177 and track stabilization unit 178. Arrow 202 indicates the operating direction of the machine whose track correction unit 173 first lifts the track to a predetermined level and lines the track by operation of one of lining drives 203 pressing against lining rollers 186 engaging the selected rail, as indicated by arrows 204. After the track position has been thus corrected, the track is fixed in the corrected position and this position is stabilized by operation of units 177 and 178. Tamping jaws 205 of the tamping tools are immersed in the ballast and are reciprocated towards a tie placed between the pairs of tamping tools in the direction of arrows 206 while the tamping tools are vibrated in the direction of double-headed arrows 200. Broken lines 207 indicate the tamping zones wherein the vibrating and reciprocating tamping tool jaws cause fluidization of the ballast. Broken line 208 indicates the stabilization zone wherein the transverse horizontal vibrations imparted to track stabilization unit 178 by vibrator means 191 cause fluidization of the ballast and this stabilization zone extends into the tamping zones so that the respective vibratory motions flow into each other and are obtained in uniformly vibrating and correspondingly compacting the ballast. This effect is further enhanced if vibrating drive means 189 of ballast tamping unit 177 and vibrator means 191 of track stabilization unit 178 are operated at the same vibrating frequency and, particularly, if they are operated in phase. In this manner, an extended zone of uniformly fluidized and compacted ballast is created between track correction unit 173 and rear undercarriage 172 and, when the latter passes over this compacted and stabilized ballast bed zone, the weight of the heavy machine resting on the undercarriage and transmitted by the undercarriage to the track, will further solidify the track position at the corrected level and line, thus producing a very long-lasting and accurately positioned track.

What is claimed is:

1. A mobile machine for compacting ballast of a ballast bed supporting a track consisting of two rails fastened to ties resting on the ballast, comprising (a) a machine frame, (b) undercarriages supporting the machine frame on the track rails for movement in an operating direction, (c) a ballast tamping unit vertically movably mounted on the machine frame, the tamping unit including (1) pairs of reciprocable and vibratory tamping tools arranged to tamp ballast under respective ones of the ties upon immersion of the tamping tools in the ballast when the tamping unit is vertically moved, (d) a track correction unit mounted on the machine frame forwardly of the tamping unit in the operating direction, (e) a track correction reference system for controlling the track correction unit, (f) a track stabilization unit mounted on the machine frame rearwardly of the tamping unit in the operating direction in a range of the machine frame extending from the tamping unit to one of the undercarriages immediately following the tamping unit, no undercarriage supporting the machine frame on the track between the tamping unit and the one undercarriage, the track stabilization unit including (1) a chassis, (2) guide roller means firmly holding the chassis in engagement with the track rails and guiding the chassis along the track upon movement of the machine frame in the operating direction, (3) vibrator means for imparting essentially horizontal vibrations to the track, and (4) power drive means connecting the chassis to the machine frame and arranged to impart essentially vertical load forces to the chassis, and (g) control means for operating the ballast tamping, track correction and track stabilization units.

2. The mobile machine of claim 1, wherein the track correction unit includes means for lifting and tranversely moving the track and the reference system includes a system for leveling the track and a system for lining the track, the machine being a track tamping, leveling and lining machine.

3. The mobile machine of claim 1 or 2, wherein the machine frame is an elongated frame supporting the track correction, ballast tamping and track stabilization units between two of said undercarriages.

4. The mobile machine of claim 1 or 2, wherein the track stabilization unit is arranged immediately rearwardly of the ballast tamping unit and as close thereto as possible.

5. The mobile machine of claim 1 or 2, wherein the track stabilization unit is arranged on the machine frame in the region of the one undercarriage.

6. The mobile machine of claim 1 or 2, wherein the ballast tamping unit comprises a vibratory drive means for imparting to the tamping tools vibrations extending in the operating direction and/or transversely thereto.

7. The mobile machine of claim 6, wherein the vibrator means and the vibratory drive means are arranged to impart to the chassis of the track stabilization unit and to the tamping tools of the tamping unit vibrations in phase with each other.

8. The mobile machine of claim 2, wherein the control means comprises a control for operating the power drive means and vibrator means of the track stabilization unit, the control being responsive to the system for leveling the track.

9. The mobile machine of claim 1 or 2, wherein the ballast tamping unit comprises a vertically adjustable stop cooperating with a respective one of the rails for limiting the vertical movement of the tamping unit, the stop being fixable at an adjusted vertical position.

10. The mobile machine of claim 9, wherein the adjustment of the stop is responsive to the track correction system.

11. The mobile machine of claim 1 or 2, further comprising means for selectively imparting to the power drive and vibrator means of the track stabilization unit a predetermined vibrating frequency and/or force.

12. The mobile machine of claim 11, wherein the control means is arranged to operate the selective means for imparting the predetermined vibrating frequency and/or force.

13. The mobile machine of claim 12, further comprising vibratory means for selectively vibrating the tamping tools outside their tamping cycle for tamping ballast under the respective ties.

14. A mobile machine for compacting ballast of a ballast bed supporting a track consisting of two rails fastened to ties resting on the ballast, comprising (a) a machine frame, (b) undercarriages supporting the machine frame on the track rails for movement in an operating direction, one of the undercarriages being a front undercarriage in the operating direction, the machine frame extending forwardly of the front undercarriage and comprising an elongated carrier connected to the forwardly extending machine frame, and another undercarriage supporting the elongated carrier on the track rails, (c) a ballast tamping unit vertically movably mounted on the forwardly extending machine frame, the tamping unit including (1) pairs of reciprocable and vibratory tamping tools arranged to tamp ballast under respective ones of the ties upon immersion of the tamping tools in the ballast when the tamping unit is vertically moved, (d) a track correction unit mounted on the elongated carrier of the machine frame, (e) a track correction reference system for controlling the track correction unit, (f) a track stabilization unit mounted on the forwardly extending machine frame rearwardly of the tamping unit in the operating direction in a range of the machine frame extending from the tamping unit to the front undercarriage, the front undercarriage immediately following the tamping unit and no undercarriage supporting the machine frame on the track between the tamping unit and the front undercarriage, the track stabilization unit including (1) a chassis, (2) guide roller means firmly holding the chassis in engagement with the track rails and guiding the chassis along the track upon movement of the machine frame in the operating direction, (3) vibrator means for imparting essentially horizontal vibrations to the track, and (4) power drive means connecting the chassis to the machine frame and arranged to impart essentially vertical load forces to the chassis, and (g) control means for operating the ballast tamping, track correction and track stabilization units.

15. A mobile machine for compacting ballast of a ballast bed supporting a track consisting of two rails fastened to ties resting on the ballast, comprising (a) a machine frame, (b) undercarriages supporting the machine frame on the track rails for movement in an operating direction, (c) a ballast tamping unit vertically movably mounted on the machine frame, the tamping unit including (1) pairs of reciprocable and vibratory tamping tools arranged to tamp ballast under respective ones of the ties upon immersion of the tamping tools in the ballast when the tamping unit is vertically moved, (d) a track correction unit mounted on the machine frame forwardly of the tamping unit in the operating direction, (e) a track correction reference system for controlling the track correction unit, (f) a track stabilization unit mounted on the machine frame rearwardly of the tamping unit in the operating direction in a range of the machine frame extending from the tamping unit to one of the undercarriages immediately following the tamping unit, no undercarriage supporting the machine frame on the track between the tamping unit and the one undercarriage, and the track stabilization unit being arranged in the region of the one undercarriage, the track stabilization unit and the one undercarriage constituting a single mechanical structure and the track stabilization unit including (1) a chassis, (2) guide roller means firmly holding the chassis in engagement with the track rails and guiding the chassis along the track upon movement of the machine frame in the operating direction, (3) vibrator means for imparting essentially horizontal vibrations to the track, and (4) power drive means connecting the chassis to the machine frame and arranged to impart essentially vertical load forces to the chassis, and (g) control means for operating the ballast tamping, track correction and track stabilization units.

16. A method of compacting ballast of a ballast bed supporting a track consisting of two rails fastened to ties resting on the ballast with a mobile machine comprising a machine frame supported on undercarriages for moving the machine in an operating direction, the ballast compacting method including the steps of (a) tamping ballast successively under respective ones of the ties in successive tamping zones, (b) simultaneously imparting to the track essentially horizontal vibrations extending transversely to the track and subjecting the track to essentially vertical load forces in successive ballast stabilization zones immediately adjacent, and rearwardly of, the successive tamping zones, the stabilization zones overlapping the tamping zones, whereby the ballast in the overlapping zones is so fluidized that it attains a maximum density and a correspondingly reduced volume, causing the track supported on the ballast to sink to a desired level corresponding to the reduced ballast volume, and (c) holding the track at the desired level under the load of one of the undercarriages rearwardly of the overlapping ballast tamping and stabilization zones in the operating direction.

17. The ballast compacting method of claim 16, wherein the track is raised to a desired level before the ballast is tamped.

18. The ballast compacting method of claim 16, wherein the track is raised to a desired level by upward pressure of the tamped ballast and is held at the desired level while tamping is continued until a desired ballast density has been attained.

19. The ballast compacting method of claim 16, wherein the track is first raised slightly above a desired level, the ballast is tamped at this level, and the track is then lowered to the desired level by fluidizing the ballast and holding the track at the desired level under the load of the one undercarriage.

20. The ballast compacting method of claim 16, further comprising the steps of measuring the level of the track before and after tamping the ballast to obtain actual level measuring values, comparing the values with a value of the desired track level and determining any required raising and subsequent lowering of the track level on the basis of the comparison values.

21. The ballast compacting method of claim 20, further comprising the step of automatically controlling the vertical movement of the track in response to the comparison values in relation to a reference system.

* * * * *

UNITED STATES PATENT AND TRADEMARK OFFICE

CERTIFICATE OF CORRECTION

PATENT NO. : 4,430,946

DATED : FEBRUARY 14, 1984

INVENTOR(S) : THEURER ET AL

It is certified that error appears in the above—identified patent and that said Letters Patent is hereby corrected as shown below:

Cover page, [73], Assignee's name should read --Franz Plasser Bahnbaumaschinen-Industrie-Gesellschaft m.b.H.--

Signed and Sealed this

*Twenty-sixth* Day of *March 1985*

[SEAL]

*Attest:*

DONALD J. QUIGG

*Attesting Officer*

*Acting Commissioner of Patents and Trademarks*